US005477013A

United States Patent [19]

Okugawa et al.

[11] Patent Number: 5,477,013

[45] Date of Patent: Dec. 19, 1995

[54] SOUNDPROOFING DEVICE FOR A RESONANT SCANNER

[75] Inventors: Hisashi Okugawa, Yokohama; Akira Adachi, Sagamihara, both of Japan

[73] Assignee: Nikon Corporation, Tokyo, Japan

[21] Appl. No.: 181,459

[22] Filed: Jan. 14, 1994

[30] Foreign Application Priority Data

Jan. 14, 1993 [JP] Japan ..... 5-021749

[51] Int. Cl.[6] ..... G10K 11/04

[52] U.S. Cl. ..... 181/200

[58] Field of Search ..... 181/200, 201, 181/202, 207, 208, 209; 248/638

[56] References Cited

U.S. PATENT DOCUMENTS 4,215,763 8/1980 Pasko ..... 181/202
5,048,904 9/1991 Montagu ..... 359/202

*Primary Examiner*—Khanh Dang

[57] ABSTRACT

A soundproofing device for a resonant scanner for deflecting a laser beam includes a plate member for fixing the resonant scanner, a plurality of stanchions for supporting the plate member, and a base for fixing the stanchions. The stanchions support the plate member at a position at which an amplitude of the plate member at a resonant frequency of the resonant scanner is minimum.

12 Claims, 2 Drawing Sheets

SOUNDPROOFING DEVICE FOR A RESONANT SCANNER

BACKGROUND OF THE INVENTION

1. Field of the Invention

The present invention relates to a noiseproofing apparatus for a resonant scanner. The resonant scanner is means for deflecting a laser beam and it is primarily used for a laser scanning microscope, a laser beam printer and a bar code reader. The soundproofing device is intended to prevent a sound generated by vibration of the resonant scanner from leaking external to the resonant scanner.

2. Description of the Related Art

Apparatus such as a laser scanning microscope, a laser beam printer and a bar code reader have a unit for deflecting a laser beam. The laser beam deflection unit usually uses a Galvanometer scanner, a polygon mirror or an acousto-optical deflection device (AOM). However, the Galvanometer scanner is low in speed, the polygon mirror has a poor durability and a large external dimension because it uses a wearing part, such as a bearing, and the acousto-optical deflection device has a small deflection angle.

The resonant scanner is laser deflection means which solves these disadvantages. The resonant scanner is superior overall to the laser deflection means such as the Galvanometer scanner in the deflection (scanning) speed and the durability, and a use of the resonant scanner as the laser beam deflection means is been known, for example U.S. Pat. No. 5,048,904.

The resonant scanner deflects the laser beam while it is resonated at a resonance frequency between several hundred Hz and several KHz, and a high speed resonant scanner is driven at a resonant frequency between 2 and 8 KHz. However, since such a relatively high resonant frequency is very close to a natural frequency of a surrounding metal (for example, a case), the resonant scanner may resonate the metal and when the sound is propagated through air, it generates a sound in a band which is most sensible and uncomfortable to a human's sense. Accordingly, the apparatus which uses the resonant scanner generates a very uncomfortable sound (resonant sound) due to the vibration of the resonant scanner and the resonant scanner cannot be used in a vicinity of an apparatus with which a human operates.

SUMMARY OF THE INVENTION

It is an object of the present invention to provide a soundproofing device for a resonant scanner which prevents sound generated by the vibration of the resonant scanner from leaking external to the resonant scanner. As a result, the resonant scanner which is very excellent as the laser deflection means can be utilized in various apparatus.

The soundproofing device for the resonant scanner of the present invention comprises a plate member and a plurality of support stanchions. The plate member fixes the resonant scanner and the stanchions couple the plate member to a base. The stanchions support the plate member at a position at which an amplitude of the plate member at a resonant frequency of the resonant scanner is minimum.

Accordingly, the soundproofing device of the present invention has a small amplitude of the plate member, a small vibration propagated to the base and a small resonant sound.

The soundproofing device of the present invention is preferably provided with a sound insulation member which surrounds the resonant scanner and the plate member.

In accordance with the soundproofing device of the resonant scanner of the present invention, little vibration of the resonant scanner is propagated to the base so that the resonant sound of the resonant scanner is hard to leak to the external and the resonant scanner may be used in an apparatus with which a human operates closely.

DETAILED DESCRIPTION OF THE PREFERRED EMBODIMENTS

Figure 1:
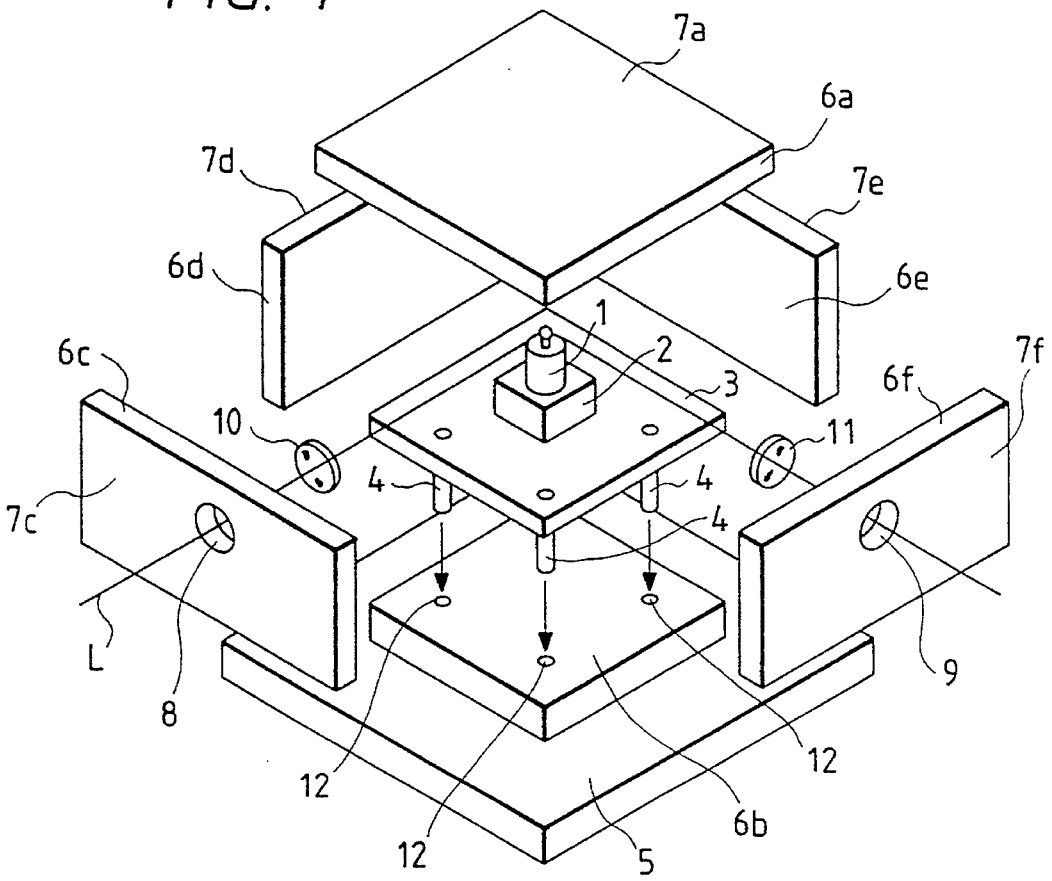
FIG. 1 shows a developed perspective view of a soundproofing device of an embodiment of the present invention.

As shown in FIG. 1, a resonant scanner 1 is supported by a scanner holding block 2 which is fixed to a plate member 3 made of bakelite. The plate member 3 is supported by four stanchions 4 made of Derlin which are linked to a base 5 of a laser scanning microscope, for example.

The plate member 3 is made of bakelite, and it has a primary natural vibration mode when it is appropriately shaped. A vibration mode of the plate member 3 changes with a material and a shape of the plate material 3. The plate member 3 may be made of a non-metal plate other than bakelite or it may be made of a metal plate such as aluminum. When the plate member 3 is made of aluminum, the plate member 3 may have a shape of 100 mm in length by 40 mm in width by 10 mm in thickness so that it has a primary natural vibration mode.

Figure 2:
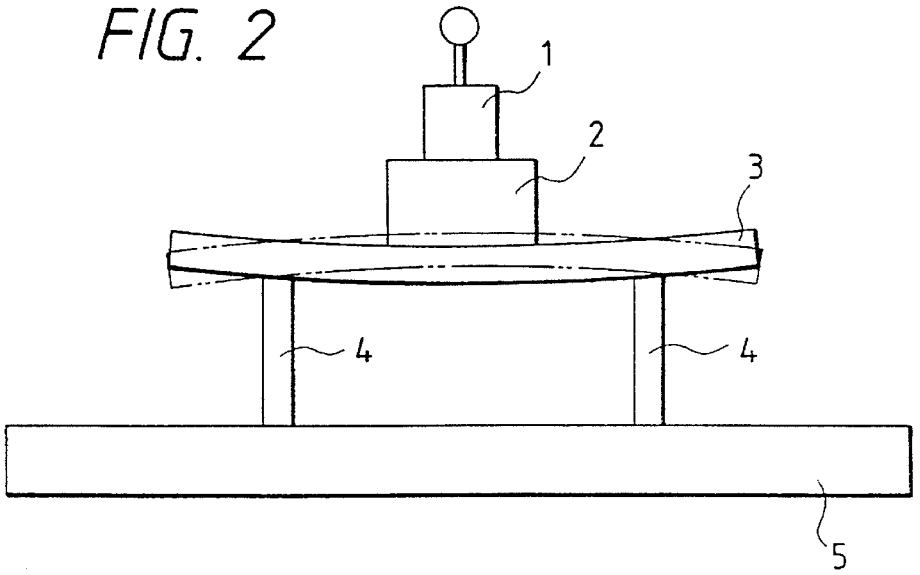
FIG. 2 shows a conceptual view illustrating a position of stanchions to a plate member which is vibrated in a primary natural vibration mode.

FIG. 2 shows a conceptual view for illustrating a position of the stanchions 4 to the plate member 3 which is vibrated in the primary natural vibration mode. When the plate member 3 is forcibly vibrated, the plate member 3 is vibrated at a specific vibration mode. In the present embodiment, it is the primary vibration mode. The vibration mode of the plate member 3 is determined and the plate member 3 is fixed to the stanchions 4 at the position (a node of the vibration) at which the amplitude of the plate member 3 at the resonant frequency of the resonant scanner 1 is minimum.

In the present embodiment, the vibration mode of the plate member 3 is predetermined at the resonant frequency of the resonant scanner 1 and the plate member 3 is linked to the stanchions 4 at the position at which the amplitude of the plate member 3 is minimum. Alternatively, the fixing position of the stanchions 4 may be predetermined and the material and the shape of the plate member 3 may be chosen so that that position serves as a node of the vibration mode. The node of the vibration mode may be searched by using an acceleration pickup method.

The resonant scanner 1 and the plate member 3 are accommodated in a box-shaped soundproofing member which comprises a top plate **6*a*, a bottom plate 6*b* and side plates 6*c*, 6*d*, 6*e* and 6*f***. Those plates have soundproofing members applied thereon which are made of glasswool. The plates themselves are preferably also made of a soundproofing material.

The bottom plate 6b is mounted on the base 5 and has holes 12 formed through which the stanchions extend. Metal plates 7a, 7c, 7d, 7e and 7f are applied to outer walls of the top plate 6a and the side plates 6c, 6d, 6e and 6f, respectively. A window 8 through which a laser beam L is transmitted to the resonant scanner is formed in the side plate 6c and the metal plate 7c, and a window 9 through which the laser beam L is transmitted out is formed in the side plate 6f and the metal plate 6f. Transparent plates 10 and 11 are mounted on the windows 8 and 9, respectively.

The laser beam L passes through the window 8 and enters into the soundproofing member, and it is deflected by the resonant scanner 1 and sent out of the window 9. The sound of the resonant scanner 1 which is propagated through air in the soundproofing member is absorbed by the soundproofing member 6. The sound of the resonant scanner 1 which passes through the soundproofing member 6 is reflected by the metal plates 7a, 7c, 7d, 7e and 7f, and it is absorbed when it again passes through the soundproofing member 6. Accordingly, the sound is further reduced.

When the resonant scanner 1 is vibrated, the plate member 3 is vibrated in the primary natural vibration mode. However, since the stanchions 4 support the plate member 3 at the position at which the amplitude of the plate member at the resonant frequency of the resonant scanner 1 is minimum as described above, little vibration of the plate member 3 is propagated to the base 5 through the stanchions 4. As a result, the resonant sound of the resonant scanner 1 is hard to leak to the external, and the vibration energy of the resonant scanner 1 is absorbed by the plate member 3.

Figure 3:
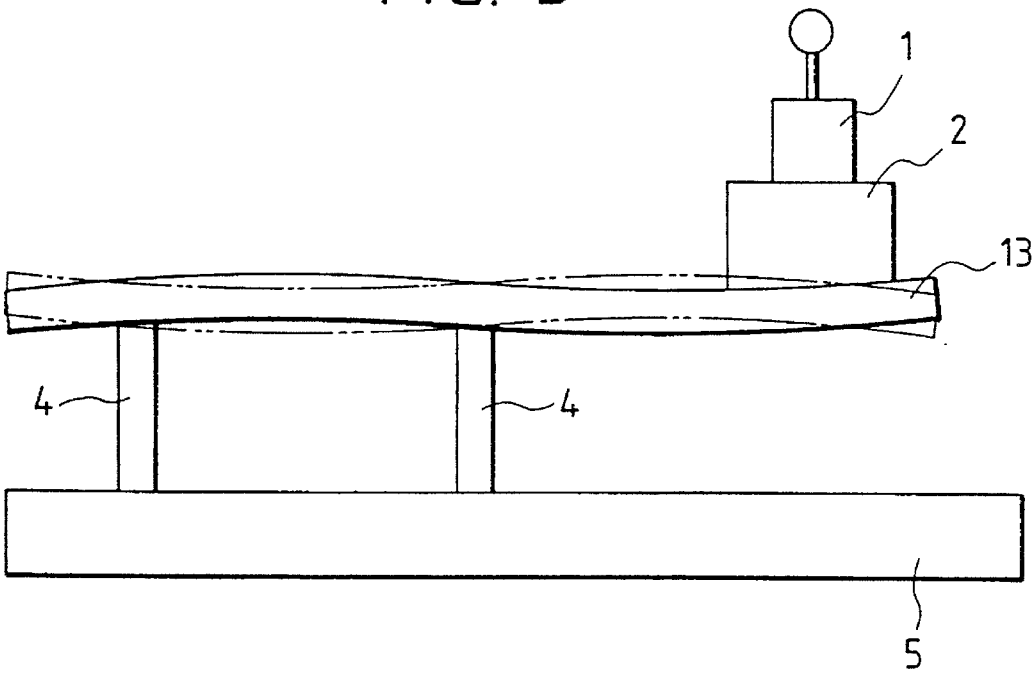
FIG. 3 shows a conceptual view illustrating a position of the stanchions to the plate member which is vibrated in a 3-order natural vibration mode.
Figure 4:
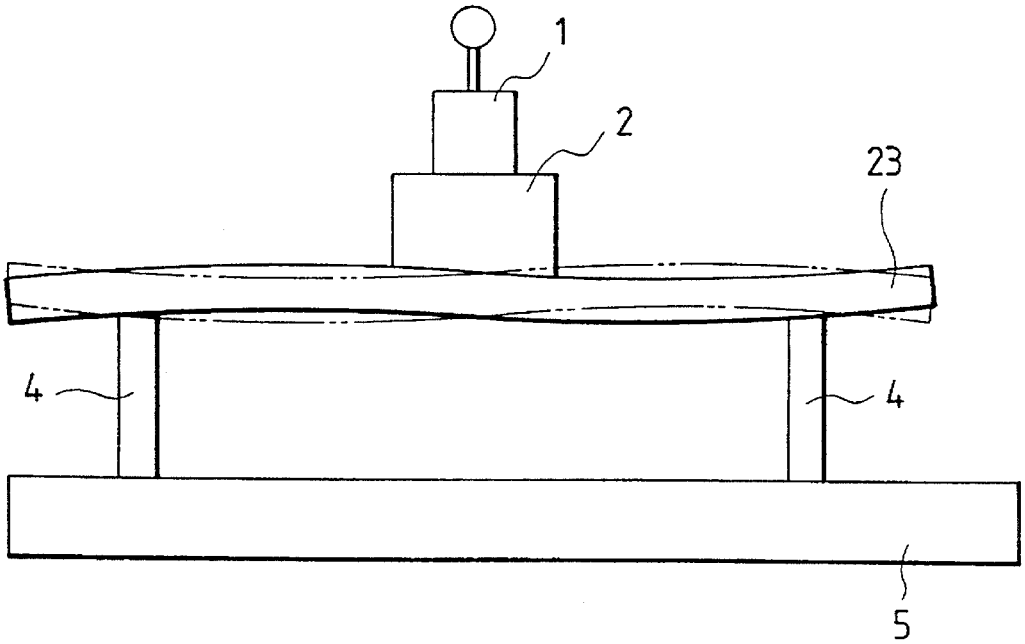
FIG. 4 shows a conceptual view illustrating a position of the stanchions to the plate member which is vibrated in the 3-order natural vibration mode.

FIGS. 3 and 4 show other embodiments and show conceptual views illustrating the positions of the stanchions which support the plate member. The like elements to that of the previous embodiment are designated by the like numerals and the explanation thereof is omitted. In the previous embodiment, the fixing position of the stanchions 4 to the plate member 3 which is vibrated in the primary natural vibration mode is as shown in FIG. 2. Alternatively, the plate member 3 may be fixed to the stanchion at a position at which the vibration of the plate member 13 or 23 which is vibrated in an odd-order vibration mode or in 3-order natural vibration mode is minimum, as shown in FIGS. 3 and 4.

In the soundproofing device for the resonant scanner shown in FIG. 13, the stanchions 4 are arranged at a leftend node and a center node, and the resonant scanner is arranged at a rightend node. On the other hand, in the soundproofing device for the resonant scanner shown in FIG. 4, the stanchions are arranged at the rightend node and the leftend node and the resonant scanner 1 is arranged at the center node. The embodiments of FIGS. 3 and 4 attain the same effects as those of the embodiment of FIG. 2.

What is claimed is:

1. A soundproofing device for a resonant scanner resonating at a predetermined frequency to deflect a laser beam, comprising:

a plate member to support said resonant scanner on a surface of the plate member;

a plurality of stanchions supporting said plate member and a base to which said plate member is fixed by said stanchions, said stanchions supporting said plate member at a position at which an amplitude of vibration of said plate member caused by resonance of said resonant scanner is minimum.

2. A soundproofing device for a resonant scanner according to claim 1, wherein a size and shape of said plate member are such that said plate member vibrates in an odd-order vibration mode by resonance of said resonant scanner.

3. A soundproofing device for a resonant scanner according to claim 1, wherein said plate member vibrates in a primary vibration mode.

4. A soundproofing device for a resonant scanner according to claim 1 wherein said plate member vibrates in a 3-order vibration mode.

5. A soundproofing device for a resonant scanner according to claim 1, further comprising a soundproofing wall surrounding a space in which said resonant scanner and said plate member are contained, and wherein said soundproofing wall has an opening through which the laser beam irradiated to said resonant scanner passes and an opening through which the laser beam deflected by said resonant scanner passes.

6. A soundproofing device for a resonant scanner according to claim 5, wherein said soundproofing wall includes an inner wall contacting said space in which said resonant scanner and said plate member are contained to absorb a sound from said resonant scanner, and a metal layer disposed on an opposite side of said space with respect to said inner wall to reflect the sound.

7. A soundproofing device for a resonant scanner resonating at a predetermined frequency so as to deflect a laser beam, comprising:

a plate member to support said resonant scanner on a surface of the plate member;

a plurality of stanchions supporting said plate member; and a base to which said plate member is fixed by said stanchions, said stanchions supporting said plate member at nodes of vibration of said plate member caused by resonance Of said resonant scanner

8. A soundproofing device for a resonant scanner according to claim 7, wherein a size and a shape of said plate member are determined so that said plate member vibrates in an odd-order vibration mode by resonance of said resonant scanner.

9. A soundproofing device for a resonant scanner according to claim 8 wherein said plate member is vibrated in a primary vibration mode.

10. A soundproofing device for a resonant scanner according to claim 8 wherein said plate member is vibrated in a 3-order vibration mode.

11. A soundproofing device for a resonant scanner as recited in claim 7, further comprising:

a soundproofing wall surrounding a space in which said resonant scanner and said plate member are contained, and wherein said soundproofing wall has an opening through which the laser beam irradiated to said resonant scanner passes and an opening through which the laser beam deflected by said resonant scanner passes.

12. A soundproofing device for a resonant scanner as recited in claim 11, wherein said soundproofing wall has an inner wall contacting said space to absorb a sound from said resonant scanner, and a metal layer disposed on the opposite side of said space with respect to said inner wall to reflect the sound.

* * * * *